United States Patent [19]

Lacasse et al.

[11] Patent Number: 4,989,535

[45] Date of Patent: Feb. 5, 1991

[54] COMBINATION STEERING CONSOLE AND REFRESHMENT CENTER FOR PONTOON BOAT

[75] Inventors: Alain D. Lacasse, Palm Bay; Michael T. Lilly, Melbourne, both of Fla.

[73] Assignee: Brunswick Corporation, Skokie, Ill.

[21] Appl. No.: 427,713

[22] Filed: Oct. 27, 1989

[51] Int. Cl.[5] ..... B63B 17/00

[52] U.S. Cl. ..... 114/343; 114/144 R

[58] Field of Search ..... 114/144 R, 188, 270, 114/343; 224/273, 276

[56] References Cited

U.S. PATENT DOCUMENTS 4,706,810 11/1987 Petrilli ..... 114/343

*Primary Examiner*—Joseph F. Peters, Jr.
*Assistant Examiner*—Jesüs D. Sotelo
*Attorney, Agent, or Firm*—Andrus, Sceales, Starke & Sawall

[57] ABSTRACT

A combination steering console and refreshment center for a pontoon boat. The console includes a first face on which a steering wheel is mounted and a second opposed face. The upper portion of the second face is provided with an opening that is enclosed by a hinged cover which is movable from a closed position to a generally horizontal open position. A horizontal serving counter is disposed in the housing and is formed with a plurality of wells; one of the wells can constitute a sink, a second well can constitute a cooler and the third well can serve as a bottle rack. A generally vertical backsplash extends upwardly from the rear edge of the counter and a removable, flexible curtain joins the backsplash with the upper wall of the console. By disengaging the curtain, access can be had to equipment located behind the first face of the console.

18 Claims, 2 Drawing Sheets

FIG. 2
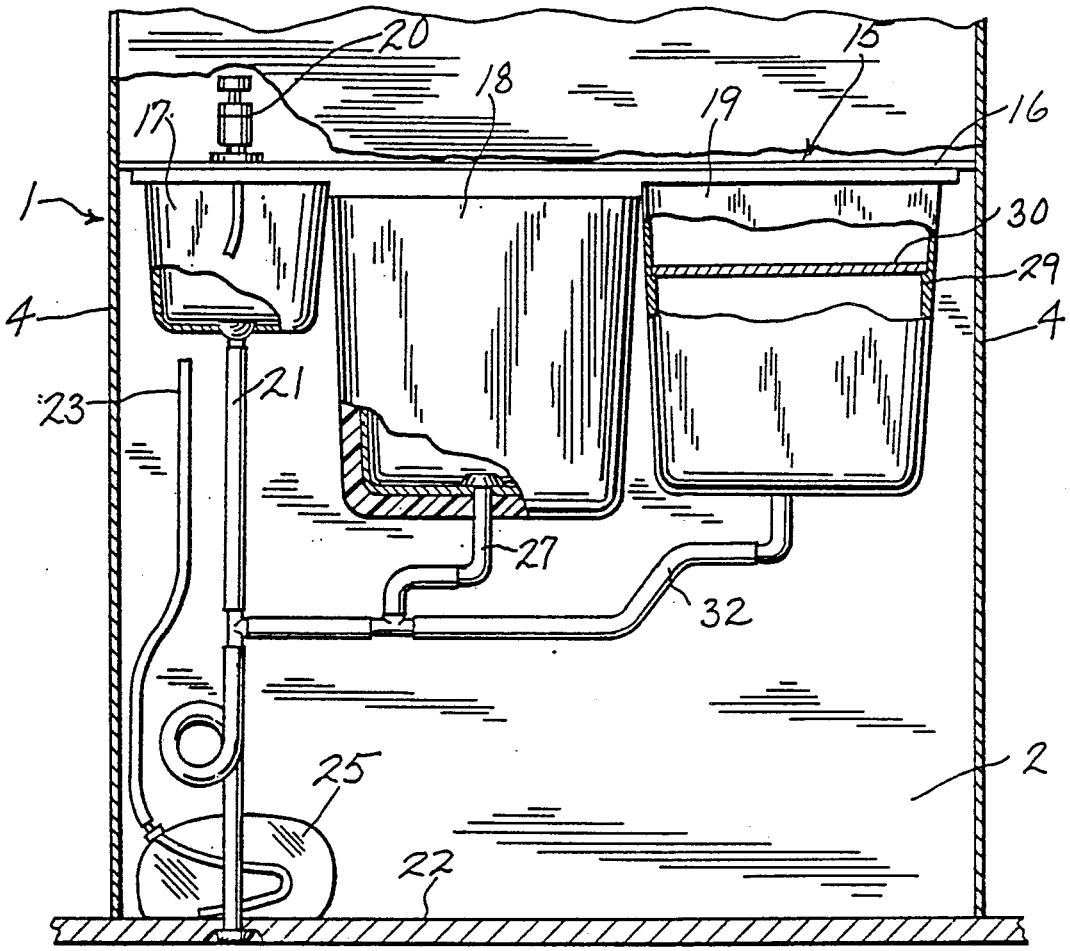
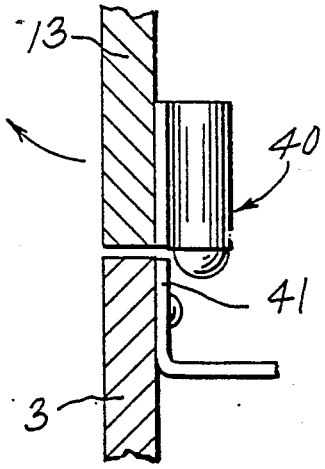
FIG. 4

COMBINATION STEERING CONSOLE AND REFRESHMENT CENTER FOR PONTOON BOAT

BACKGROUND OF THE INVENTION

Pontoon boats generally include an upright console and a steering wheel and instrument gauges are mounted on the aft facing surface of the console. The electrical wiring for the gauges is housed within the console. If a repair to the wiring is necessary, the console must be disassembled. Because of the requirement for disassembly, the panels of the console are normally fastened together by screws and this type of connection detracts from the overall appearance of the console.

Pontoon boats also can include a sink mounted in a counter top and in other instances, insulated coolers can be mounted on the deck for storing beverages and food.

SUMMARY OF THE INVENTION

The invention is directed to a combined steering console and refreshment center having particular application for a pontoon boat. The console includes a first face which faces aft and a steering wheel and instrument gauges are mounted on the aft face.

The upper portion of the opposed forward face of the console is provided with an opening which is closed by a hinged cover that is movable between a closed position and a generally horizontal open position. When in the open position, the cover serves as a serving shelf or counter.

A horizontal counter is disposed within the console and is formed with a plurality of depressions or wells. In a preferred form of the invention, one of the wells serves as a sink, a second well can constitute a cooler, while the third well can serve as a bottle rack. A drain is connected to the lower end of each well and the drains are interconnected and lead to a disposal site.

A generally vertical backsplash extends upwardly from the rear edge of the counter and a removable flexible curtain joins the backsplash with the upper wall of the console. The curtain is normally held in place by fasteners which attach the lower end of the curtain to the backsplash. By disengaging the fasteners, the curtain can be raised to permit access to electrical wiring and other equipment located behind the rear face of the console.

The invention utilizes what would normally be dead space in a console as a refreshment center. With the hinged cover in the closed position, the wells and refreshments are completely out of sight and by moving the cover to the open position, the wells are exposed and the cover acts as a serving table.

The construction of the invention also facilitates access to the wiring and other equipment behind the rear face of the console, thereby eliminating the necessity of disassembling the console in order to have access to these components.

Other objects and advantages will appear during the course of the following description.

DESCRIPTION OF THE DRAWINGS

The drawings illustrate the best mode presently contemplated of carrying out the invention.

In the drawings:

FIG. 2 is a front elevation with the cover in the closed position and with parts broken away in section; FIG. 4 is an enlarged vertical section showing the latching mechanism for the access door.

DESCRIPTION OF THE ILLUSTRATED EMBODIMENT

Figure 1:
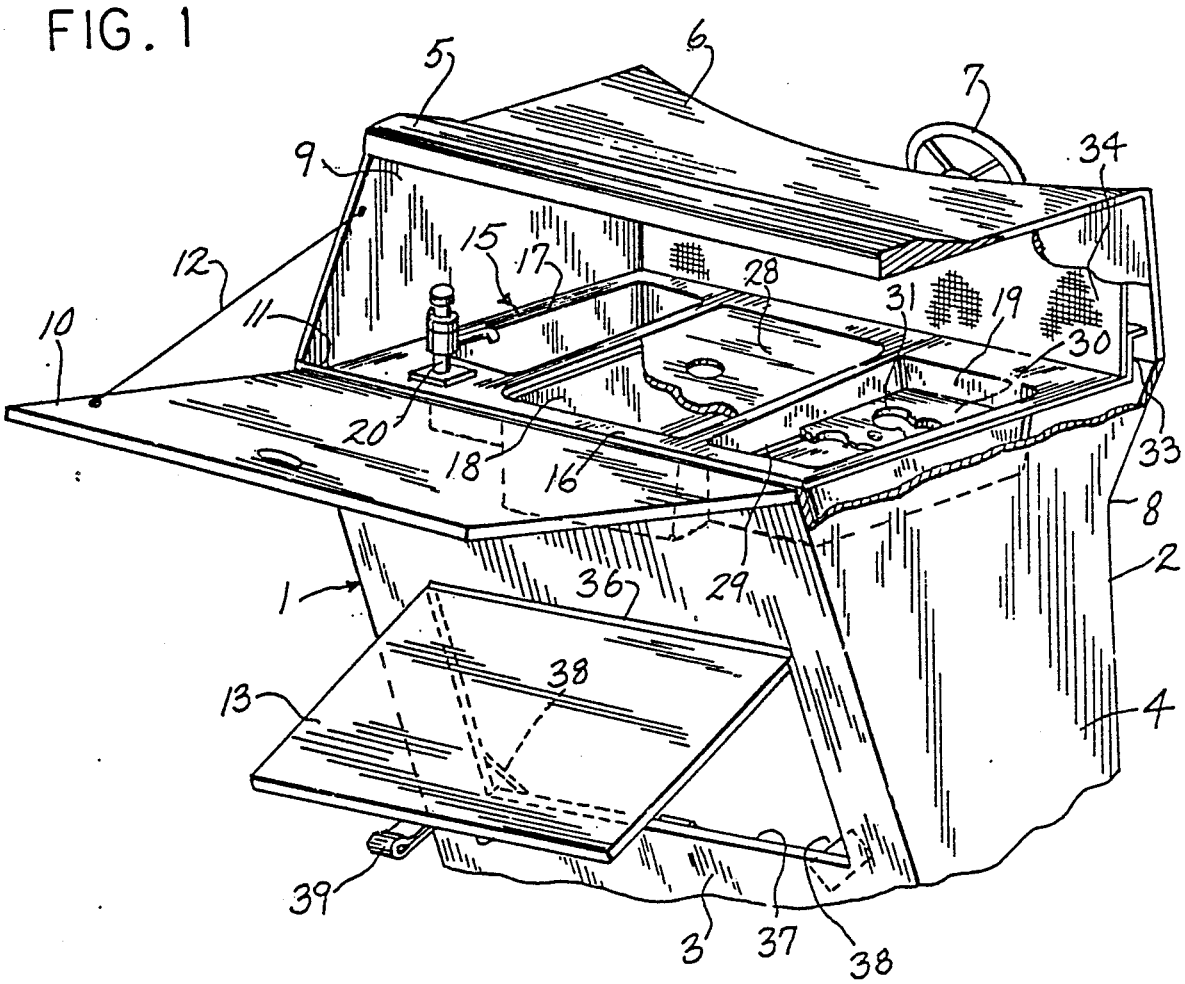
FIG. 1 is a perspective view of the console with the cover in the open position.

The drawings illustrate a combination steering console and refreshment center for a pontoon boat that includes a housing 1 composed of a rear or aft panel 2, a front panel 3 and a pair of side panels 4 which connect the corresponding edges of the front and rear panels. The upper end of rear panel 2 extends forwardly and merges into an upper panel 5 which encloses the upper end of the housing. A generally L-shaped molded plastic dash panel 6 is secured to upper panel 5 and extends downwardly over the upper portion of rear panel 2. A steering wheel 7 as well as instrument gauges are mounted in dash panel 6.

As best shown in FIG. 1, the lower portion of rear panel 2 is recessed, as indicated by 8, to provide leg room for the operator who is normally seated in a seat spaced from rear panel 2.

Figure 3:
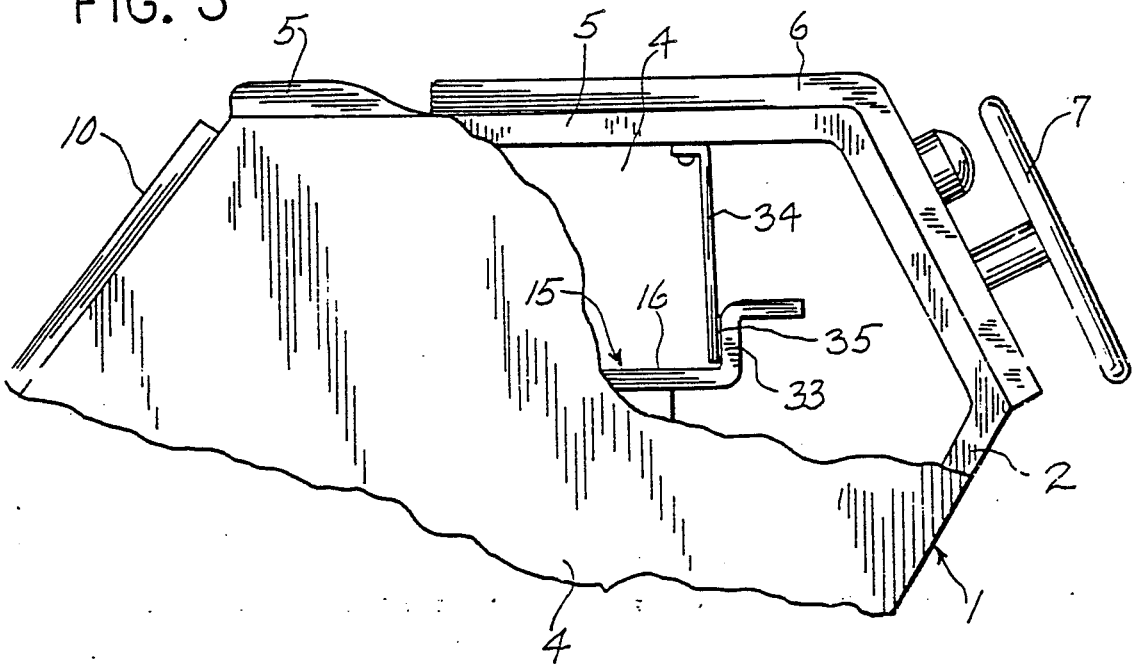
FIG. 3 is an enlarged vertical section of the upper portion of the console with parts broken away in section.

The upper portion of front panel 3 is provided with an opening 9 that can be enclosed by a cover 10. The lower edge of cover 10 is connected to the upper edge of front panel 3 by hinge 11. By pivoting cover 9 outwardly the cover can be moved from a closed position, as seen in FIG. 3, to a generally horizontal serving position, as shown in FIG. 1. The cover is held in the open horizontal positon by a pair of flexible members 12, such as cables.

The lower portion of front panel 3 is provided with an opening which is normally enclosed by an access door or panel 13.

The panels 2–4 can be formed of wood or plastic and are normally covered with a padded material to provide an attractive appearance for the housing.

A windshield, not shown, can be attached to upper panel 5.

In accordance with the invention, the interior of housing 1 contains a refreshment center or wet bar 15 that consists of a generally flat counter top 16 having three wells or depressions that define a sink 17, a storage cooler 18 and a bottle storage rack 19. In a preferred form of the invention, the counter 16 and wells 17–19 can be integrally formed of a material, such as fiber reinforced resin. Alternately, counter 16 can be formed with an opening instead of well 18 and a separate cooler can be mounted in the opening.

To supply water to sink 17, a self-priming faucet pump 20 is mounted on the counter 16 adjacent the sink.

The lower surface of sink 17 is provided with a drain opening and a drain line 21, as seen in FIG. 2, is connected to the drain opening in sink 17 and extends downwardly through an opening in deck 22 to a suitable disposal site.

Water can be supplied to faucet pump 20 through a line 23 which is connected between the faucet pump and a flexible plastic container or holding tank 25 containing water and mounted on deck 22 within housing 1. Through operation of faucet 20 water can be supplied through line 23 from container 25 to sink 17.

The outer surface of cooler well 18 is preferably coated with an insulating material, such as foam plastic insulation, and the lower end of well 18 is provided with a drain opening which is connected via drain line 27 to drain line 21.

The upper end of cooler well 18 is recessed slightly beneath the level of counter 16 and receives a generally flat removable lid 28. Lid 28 is formed of a material, such as wood or plastic, and can also serve as a cutting board when it is covering well 18.

The bottle storage well 19 is provided with a horizontal ledge 29 which is spaced above the bottom of the well 19. A plate 30 is mounted on ledge 29 and contains a plurality of openings 31 which are adapted to receive bottles so that the well 19 serves as a bottle storage rack. In addition, a drain opening is provided in the bottom of well 19 and is connected through a drain line 32 to drain lines 27 and 21.

The rear edge of counter 16 is provided with an upstanding backsplash 33, and a flexible curtain 34, formed of fabric or plastic, interconnects the under surface of panel 5 with the backsplash. In practice, the flexible curtain 34 can be secured to the under surface of panel 5 by fasteners, such as staples, while the lower edge of the curtain is removably connected to the forward surface of backsplash 33 by fasteners, such as Velcro fasteners 35. By disengaging the fasteners 35, access can be had to electrical wiring and the components that are mounted behind dash panel 6.

As illustrated in FIG. 1, the upper edge of access door 13 is connected by hinge 36 to front panel 3 so that the door can be pivoted between a closed and open position with respect to access opening 37. Metal straps 38 are secured to the inner surface of front panel 3 at the lower corners of the opening 37 and limit the inward movement of door 13. To aid in opening door 13, a pull strap 39 is attached to the lower edge of the door.

Door 13 can be locked in the closed position by a mechanism, as shown in FIG. 4. The lower edge of the inner surface of door 13 carries a spring-loaded ball catch 40 which is adapted to engage the upper edge of an angle-shaped striker plate 41 to latch the door in the closed position.

The invention incorporates a refreshment center or wet bar with the steering console and thus utilizes what would normally be dead space for the refreshment center. With the cover 10 in the closed position, the entire wet bar is enclosed and is not visible.

In addition, the invention facilitates access to the wiring and other equipment contained in housing 1 and eliminates the necessity of disassembling the console in order to obtain access to these components for repair or maintenance. As the console does not have to be disassembled, the panels can be permanently connected, thus eliminating visible screws or connectors and providing a more attractive appearance for the console.

Various modes of carrying out the invention are contemplated as being within the scope of the following claims particularly pointing out and distinctly claiming the subject matter which is regarded as the invention.

We claim:

1. A console for a boat, comprising a housing having a first face and an opposed second face, steering means mounting on said first face, said second face having an opening in the upper portion thereof, a counter disposed within the housing and disposed at a level adjacent the lower edge of said opening, a cover to removably enclose said opening, and at least one well formed in said counter.

2. The console of claim 1, wherein said housing also includes an upper surface, and a removable interior wall connecting said upper surface and the rear end of said counter, said interior wall being spaced forwardly of said first face.

3. The console of claim 2, wherein said wall comprises a flexible curtain.

4. The console of claim 3, and including an upstanding backsplash on the rear edge of said counter, said curtain being removably attached to said backsplash.

5. The console of claim 1, wherein said well comprises a sink.

6. The console of claim 1, wherein said well comprises an insulated cooler having a removable lid.

7. The console of claim 1, wherein said well comprises a bottle rack.

8. The console of claim 7, wherein said well includes a bottom surface and a generally horizontal ledge spaced upwardly of said bottom surface, and a member supported on said ledge and having a plurality of openings to receive bottles.

9. A combination steering console and refreshment center for a pontoon boat, comprising a housing having a rear face and an opposed forward face, steering means mounted on said rear face, the upper portion of said forward face having an opening, a cover hinged to said second face and movable between a closed position where it encloses said opening and a generally horizontal open position where it serves as a serving table, a horizontal counter disposed in the housing and located at a level adjacent the lower edge of said opening, said counter having a plurality of side by side wells.

10. The combination of claim 9, wherein said housing also includes an upper surface, and a flexible, internal wall connecting said upper surface with the rear end of said counter and spaced forwardly of said rear face.

11. The combination of claim 10, and including an upstanding backsplash on the rear edge of said counter, said flexible wall being removably attached between said upper surface and said backsplash.

12. The combination of claim 9, and including drain mains connected to the lower end of each well.

13. The combination of claim 9, and including means to retain the cover in the horizontal position.

14. The combinaton of claim 9, wherein one of said wells comprises a sink, and said console further includes a faucet to supply water to said sink.

15. The combination of claim 9, wherein one of said wells comprises an insulated cooler, and a removable lid to enclose the upper end of said cooler.

16. The combination of claim 9, wherein one of said wells includes a bottle storage rack.

17. The combination of claim 9, wherein said wells and said counter are integral and are composed of fiber reinforced resin.

18. The combination of claim 15, wherein said lid for said cooler is provided with a hard surface and constitutes a cutting board.

* * * * *